US009531094B2

(12) United States Patent
Lebkuecher et al.

(10) Patent No.: US 9,531,094 B2
(45) Date of Patent: Dec. 27, 2016

(54) RECEIVING SOCKET FOR RECEIVING AND MAKING CONTACT WITH AN ELECTRONIC MODULE

(71) Applicant: Pepperl + Fuchs GmbH, Mannheim (DE)

(72) Inventors: Thomas Lebkuecher, Hemsbach (DE); Werner Bansemir, Mannheim (DE); Friedrich Fuess, Dannstadt-Schauernheim (DE)

(73) Assignee: Pepperl + Fuchs GmbH, Mannheim (DE)

( * ) Notice: Subject to any disclaimer, the term of this patent is extended or adjusted under 35 U.S.C. 154(b) by 0 days.

(21) Appl. No.: 14/785,101

(22) PCT Filed: Apr. 26, 2013

(86) PCT No.: PCT/EP2013/058763

§ 371 (c)(1),
(2) Date: Oct. 16, 2015

(87) PCT Pub. No.: WO2014/173458

PCT Pub. Date: Oct. 30, 2014

(65) Prior Publication Data

US 2016/0064841 A1 Mar. 3, 2016

(51) Int. Cl.
*H01R 33/96* (2006.01)
*H01R 12/71* (2011.01)
(Continued)

(52) U.S. Cl.
CPC ..... *H01R 12/712* (2013.01); *H01R 13/7032* (2013.01); *H01R 31/00* (2013.01)

(58) Field of Classification Search
CPC ..... H01H 1/566; H01R 12/7094; H01R 33/96; H01R 13/70; H01R 13/713; H01R 24/46
(Continued)

(56) References Cited

U.S. PATENT DOCUMENTS 3,512,043 A * 5/1970 Stange ..... H01F 38/28 200/51 R
4,070,557 A * 1/1978 Ostapovitch ..... H01R 13/7032 200/51.1
(Continued)

FOREIGN PATENT DOCUMENTS

DE 4111049 A1 10/1991
DE 10229170 A1 1/2004
(Continued)

OTHER PUBLICATIONS

Teske, E., PCT/EP2013/058763, English translation of International Preliminary Report on Patentability, Nov. 2015, 7 pages.
(Continued)

*Primary Examiner* — Hae Moon Hyeon
(74) *Attorney, Agent, or Firm* — LaBatt, LLC

(57) ABSTRACT

The invention relates to a receiving socket for receiving and making contact with an electronic module (60) comprising an electronic circuit (70) which is electrically connected to a first contact tongue (80) and to a second contact tongue (90). The receiving socket comprises a first electrical contact area (22) for making contact with the first contact tongue (80) of the module, a second electrical contact area (32) for making contact with the second contact tongue (90) of the module and a contact element (40) which electrically connects the first contact area (22) to the second contact area (32) for the purpose of transferring an electrical signal when the module is removed. The first contact tongue (80) of the module can be received between the first electrical contact area (22) and the contact element (40). The second contact tongue (90) of the module can be received between the second electrical contact area (32) and the contact element (40).

11 Claims, 3 Drawing Sheets

(51) Int. Cl.
*H01R 13/703* (2006.01)
*H01R 31/00* (2006.01)

(58) Field of Classification Search
USPC ..... 200/51.09, 51.1, 51.11; 439/188
See application file for complete search history.

(56) References Cited

U.S. PATENT DOCUMENTS 4,438,303 A 3/1984 Astier
5,533,907 A 7/1996 Kozel et al.
6,062,914 A * 5/2000 Fasano ..... H01H 71/08 361/634
6,186,805 B1 * 2/2001 Krishnaswamy .. H01R 13/7032 200/51.1
6,315,588 B1 * 11/2001 Heberlein ..... H01R 13/7032 200/51.1
7,537,473 B2 * 5/2009 Johannes ..... H01R 31/08 439/188
7,955,102 B2 * 6/2011 Santos ..... H01F 27/04 439/188

FOREIGN PATENT DOCUMENTS

EP 0637045 A1 2/1995
JP 54789 A 1/1979

OTHER PUBLICATIONS

Teske, E., PCT/EP2013/058763, International Search Report with English translation, Jan. 23, 2014, 6 pages.

* cited by examiner

RECEIVING SOCKET FOR RECEIVING AND MAKING CONTACT WITH AN ELECTRONIC MODULE

BACKGROUND OF THE INVENTION

The invention relates to a receiving socket for receiving and making contact with an electronic module. In addition the invention relates to an electronic module and an assembly with an electronic module and a receiving socket for receiving and making contact with the module.

It is known to integrate in a removable manner into a switching circuit, for example a measurement, control or regulating circuit, an additional electronic module which has a circuit board. For this, a receiving socket can be provided in the switching circuit, into which receiving socket the electronic module can be inserted. The receiving socket is integrated into the switching circuit via corresponding terminals.

It is also known that corresponding receiving sockets are adapted, in the empty state, to provide an electrical connection between the terminals so that a signal path guided via the receiving socket is closed when the receiving socket is empty.

DE 102 29 170 A1 describes for example a plug-in socket with contact elements shorted in the empty state. For this, the plug-in socket has contact elements arranged lying opposite each another which are formed so that in the empty state two respective contacts are electrically conductively connected to each other. The contact elements are pressed against each other by spring forces.

A receiving socket for an electronic module with self-cleaning shorting contacts is described in U.S. Pat. No. 5,533,907. Through the formation of the contact elements lying opposite one another, when the contact elements move onto one another a parallel rubbing against each other arises, which cleans the contact elements.

U.S. Pat. 4,438,303 describes a socket and a plug for connection to a switching circuit, wherein by inserting the plug, a through contact between the input and output of the plug is interrupted. The plug comprises for this purpose a pressure element which presses an elastic guide plate into an open position when the plug is inserted.

SUMMARY OF THE INVENTION

It is the object of the invention to provide a receiving socket, an electronic module and an assembly which have a particular multiplicity of uses.

The object is achieved according to the invention by a receiving socket having the features of claim 1, an electronic module having the features of claim 11 and an assembly having the features of claim 13. Preferred embodiments of the invention are indicated in the dependent claims and the description and in the attached drawings.

The receiving socket according to the invention is provided for receiving and making contact with an electronic module which comprises an electronic circuit which is electrically connected to a first contact blade and a second contact blade. The receiving socket comprises a first electrical contact area for making contact with the first contact blade of the module, a second electrical contact area for making contact with the second contact blade of the module and a contact element which electrically connects the first contact area to the second contact area to forward an electrical signal when the module is removed. The first contact blade of the module can be received between the first electrical contact area and the contact element. The second contact blade of the module can be received between the second electrical contact area and the contact element.

The electronic module according to the invention which is provided in particular for insertion into a receiving socket according to the invention comprises an electronic circuit and a first contact blade and a second contact blade which are each electrically connected to the electronic circuit. At least one of the contact blades has an electrical contact area formed on a front side and an insulating area formed on a rear side.

The assembly according to the invention comprises an electronic module according to the invention and also a receiving socket according to the invention for receiving and making contact with the module.

A core idea of the invention can be seen in providing a receiving socket or receiving holder for receiving and making contact with an electronic module with two separate contact areas for making contact with a first or a second contact blade which are spaced apart from each other along a longitudinal axis. The contact blades are provided in particular for a signal transmission and in particular for signal supply to the electronic circuit or signal output from the electronic circuit.

It can be regarded as a further core idea of the invention that the contact areas of the receiving socket spaced apart from each other can be electrically short circuited via a separate contact element. The electrical connection of the contact areas by the contact element is realised in particular in the empty state of the receiving socket and is interrupted in the occupied state of the receiving socket. In the contact position the contact element lies against the first contact area and also against the second contact area and thus produces the electrical connection between the contact areas.

The contact element connecting the contact areas constitutes, in the empty state of the receiving socket, an electrical connection between an input and an output of the receiving socket and thus facilitates forwarding of an electrical signal through the receiving socket if no electronic module is inserted therein. In the occupied state of the receiving socket, the electrical signal can on the other hand be forwarded via the inserted module and be for example converted and/or amplified in the module.

According to a preferred embodiment the receiving socket is adapted to receive the module in two orientations rotated by 180° relative to each other. The receiving socket preferably has, for this, a symmetrical housing, into which the electronic module can be inserted in a first orientation, in which the first contact blade is received between the first electrical contact area and the contact element, and the second contact blade is received between the second electrical contact area and the contact element, and in a second orientation, in which the first contact blade is received between the second electrical contact area and the contact element and the second contact blade is received between the first electrical contact area and the contact element. In this way different switching positions can be realised through the possible positions of the module.

In order to ensure that contact can be reliably made and that the module is securely received in the receiving socket, the contact blades of the module can be clamped between the contact areas and the contact element. The receiving socket can correspondingly also be described as a clamping housing.

The contact areas and/or the contact element are preferably pre-tensioned to clamp in the contact blades of the module. For example the contact areas or the contact element can be pre-tensioned by means of a spring or formed as a contact spring. The contact areas and contact element are preferably arranged lying opposite each other and can be moved onto each other and away from each other so that a variable distance between the contact area and the contact element can be realised.

According to a preferred embodiment the contact areas are arranged in a shared plane. The contact areas are orientated substantially parallel to each other. The contact element preferably extends in a plane substantially parallel to the contact areas.

A simple mounting of the electronic module on the receiving socket can be achieved by the module being linearly insertable into the receiving socket.

The electronic module can thus preferably be inserted in a straight or linear movement direction into the receiving socket.

The receiving socket preferably comprises a housing having at least one guide bar or guide rail to receive and linearly guide the module. The guide bar particularly usefully guides the electronic module in a positive-locking way. According to a preferred embodiment, means are provided to fix the inserted module. Fixing the module can be realised for example by clamping in the contact blades, thus in a force-fitting manner.

According to an advantageous embodiment a U-shaped housing is provided with a receiving space to receive the module. The U-shaped housing preferably forms the receiving space for the electronic module between its side legs and its base. The contact areas and the contact element are advantageously located in the base of the U-shaped housing.

To receive the contact blades of the electronic module, receiving slots are preferably provided in the receiving socket, which are usefully formed or can be formed between the first contact area and the contact element or between the second contact area and the contact element.

It is preferable that the contact element is formed as a contact plate. The contact plate can extend substantially parallel to the plane of the contact areas and/or substantially parallel to the insertion direction of the module. The contact plate forms a robust and reliable electrical connection between the contact areas and can provide a reliable clamping-in of the contact blades. On the side facing towards the contact areas the contact plate has electrically conductive areas.

For arrangement in a switching circuit it is preferable that the receiving socket has a signal input and a signal output, wherein the first electrical contact area is electrically connected to the signal input and the second electrical contact area to the signal output, or vice versa. Signal input and signal output can be attached to the switching circuit and can also be designed for changing signal directions.

A core idea of the electronic module according to the invention can be seen in that at least one of the contact blades is electrically insulated on a rear side. The insulating layer formed on the rear side of the contact blade causes, when the module is inserted, the short circuit contact produced by the contact element between the input and output of the receiving socket to be interrupted. The electronic circuit of the module can be integrated in this way into the switching circuit, i.e. the signals are fed via the electronic module and not via the contact element.

A particular multiplicity of applications can be achieved by the module being symmetrically constructed such that it can be inserted into the receiving socket in two different orientations, wherein the positions of the contact blades are exchanged.

In particular, different switching positions or switching conditions can be set with this particularly preferred embodiment. In a first position of the module, which is described as a working position, the module is inserted into the receiving socket so that the front sides of the contact blades are in electrical contact with the contact areas of the receiving socket. The insulated rear sides of the contact blades hereby lie against the contact element. In this working position the signals are fed via the electronic module or the electronic circuit received therein. The electrical signal is thus passed from the input of the receiving socket through the module to the output of the receiving socket.

By rotating the module, the module can be inserted into the receiving socket in a second position, which is also described as the start-up position. In this start-up position the rear sides of the contact blades contact the electrically conductive contact areas of the receiving socket. The electrically conductive front sides of the contact blades lie against the contact element of the receiving socket. Through the insulating area formed against at least one of the contact blades, the input of the receiving socket is separated from the output. The signal path via the receiving socket is thus interrupted.

If the module is withdrawn or removed, the signal is passed from the input through the contact element directly to the output. This position is described as the exchange position.

Having regard to the switching positions to be achieved it is preferable with respect to the assembly formed by the electronic module and the receiving socket that the module can be positioned in the receiving socket in two different orientations, wherein the contact blades of the module are respectively received between the contact areas and the contact element of the receiving socket, that in a first orientation of the module an electrical contact exists between the first contact blade of the module and the first contact area of the receiving socket and also between the second contact blade of the module and the second contact area of the receiving socket, and that in a second orientation of the module the electrical contact between at least one of the contact blades of the module and the corresponding contact area of the receiving socket is interrupted by an insulating area formed on the contact blade.

The assembly according to the invention can be used with particular advantage in a switching circuit. It is thus preferred according to the invention that the assembly is arranged in a switching circuit which in particular has a sensor and/or an actuator. The sensor can for example be a two-wire sensor. The switching circuit can be designed in particular as a switching circuit for transmitting energy and/or data, in particular switching or measurement signals.

BRIEF DESCRIPTION OF THE DRAWINGS

The invention will be described in more detail below using an example embodiment which is shown schematically in the attached figures, in which.

The same components or those acting in the same way are generally identified by the same reference numerals in all the figures.

DETAILED DESCRIPTION OF THE INVENTION

Figure 1:
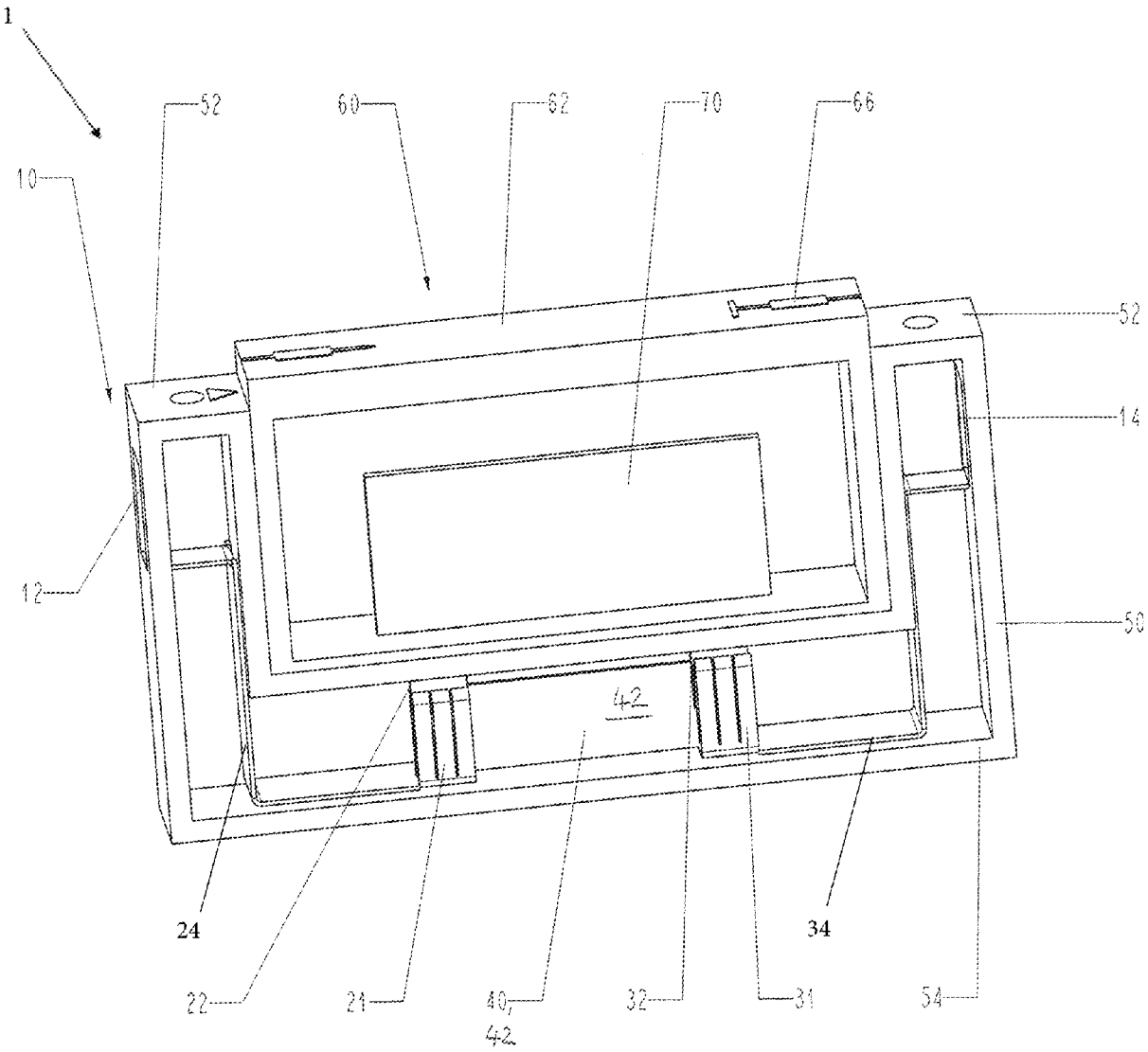
FIG. 1 shows an assembly according to the invention with an electronic module in a working position.

An assembly 1 according to the invention comprises a receiving socket 10 and an electronic module 60 which can be inserted into the receiving socket 10.

The receiving socket 10 comprises an electrical input 12, in particular a signal input, and an electrical output 14, in particular a signal output. With the input 12 and the output 14 the receiving socket 10 can be attached to an electrical switching circuit.

The receiving socket 10 comprises a housing 50 which is designed in a U shape in the embodiment shown and has two side legs 52 arranged lying opposite and parallel to each other and also a lower base 54. A receiving space for receiving the electronic module 60 is formed between the side legs 52 and the base 54. The side legs 52 each comprise a guide rail 56 for linearly guiding or linearly inserting or pushing the electronic module 60 into the receiving socket 10.

A first receiving slot 20 to receive a first contact blade 80 of the electronic module 60 and a second receiving slot 30 to receive a second contact blade 90 of the electronic module 60 are formed in the base 54 of the housing 50.

Inside the U-shaped housing 50 a hollow space is formed, in which a first contact part 21 with a first contact area 22 and a second contact part 31 with a second contact area 32 are positioned. The contact areas 22, 32 are arranged so that a contact blade pushed through the receiving slot 20 or 30 makes contact with the contact area 22 or 32. The contact areas 22, 32 are arranged spaced apart and parallel to each other along a longitudinal axis of the receiving socket 10 and in particular in a shared plane.

A contact element 40, which is designed in the present case as a contact plate, extends between the contact parts 21, 31 and contact areas 22, 32. The contact element 40 comprises a contact side 42 which lies opposite the contact areas 22, 32. The contact areas 22, 32 can each be contacted by the contact side 42 of the contact element 40. On the contact side 42, electrically conductive areas lying opposite the contact areas 22, 32 are formed, which are electrically connected to each other. The contact plate is preferably designed completely as an electrically conductive plate.

To produce the contact between the contact element 40 and the contact areas 22, 32, the contact parts are spring loaded with the contact areas 22, 32 or designed as springs and press against the contact element 40. Alternatively or additionally, the contact element 40 can also be spring loaded or designed as a spring element.

When inserting the electronic module 60 into the receiving socket 10 the contact parts 21, 31 and the contact element 40 are pressed apart from each other by the contact blades 80, 90.

To produce an electrical connection between the input 12 and the first contact area 22, and between the output 14 and the second contact area 32, a respective electrical line 24 or 34 is provided.

The electronic module 60 comprises a module housing 62, in which an electronic circuit 70, in particular a printed circuit board, is received. The printed circuit board comprises a substrate, on which a plurality of electronic components are arranged.

On opposing side regions of the module housing 62 a respective linear guide means 64 is provided, which is designed to cooperate with the guide rail 56 of the receiving socket 10. In this way the electronic module 60 can be linearly inserted or pushed into the receiving region of the receiving socket 10.

The first contact blade 80 and the second contact blade 90 are formed on a lower side area of the module housing 62 and protrude with respect to the module housing 62. In principle the contact blades 80, 90 can, however, also be integrally formed with the module housing 62 and/or integrated into the outer contour of the module housing 62.

The first contact blade 80 comprises an electrically conductive front side 82 and an electrically insulated rear side 84. The second contact blade 90 comprises an electrically conductive front side 92 and also an electrically insulated rear side 94.

The contact blades 80, 90 are designed roughly in plate-form with planar areas lying opposite each other in order to be received or clamped in a slot-form receiving space between the first contact area 22 and the contact element 40 or the second contact area 32 and the contact element 40.

FIG. 1 shows the assembly 1 in a working position. The electronic module 60 is inserted into the receiving socket 10 and the electrically conductive front sides 82, 92 of the contact blades 80, 90 contact the contact areas 22, 32 so that an electrical signal can be passed from the input 12 via the module 60 to the output 14.

By removing the module 60 from the receiving socket 10, rotating it by 180° and reinserting it in the rotated position, a start-up position is reached, in which the insulated rear sides 84, 94 of the contact blades 80, 90 lie against the contact areas 22, 32. The input 12 is hereby electrically separated from the output 14.

Figure 2:
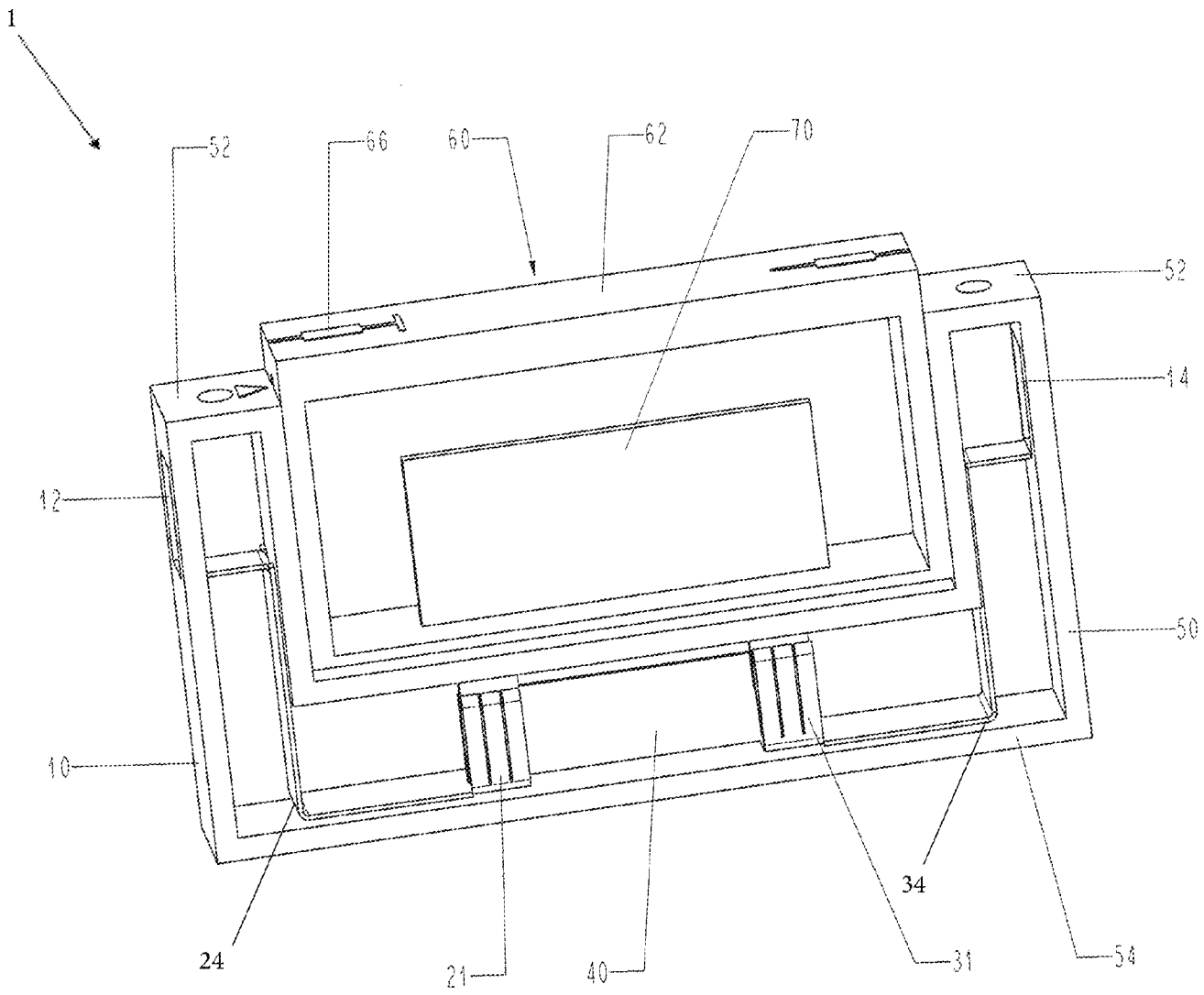
FIG. 2 shows the assembly with the electronic module in a start-up position and FIG. 3 shows the assembly with the electronic module in an exchange position.
Figure 3:
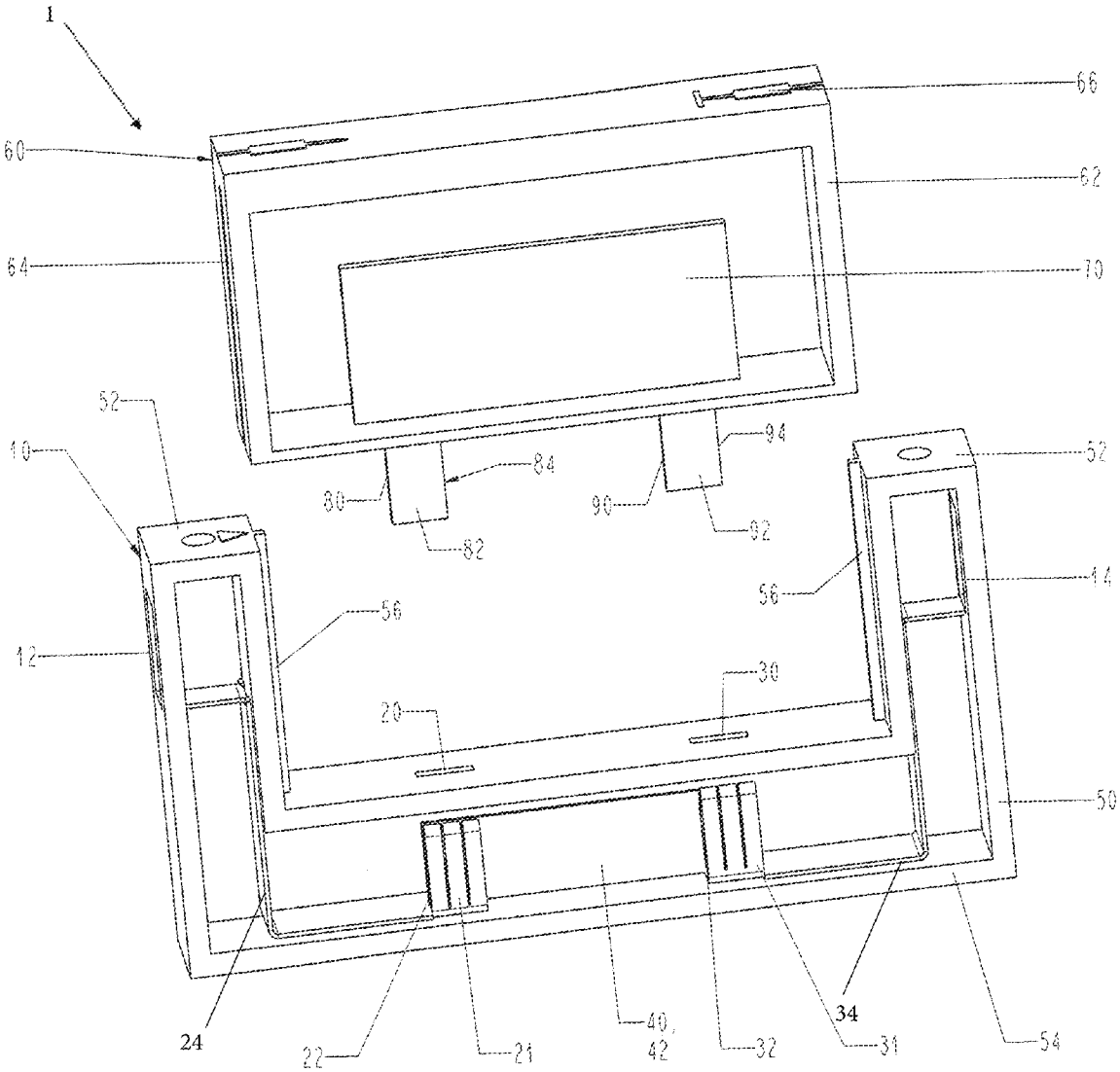

To illustrate the orientation of the module 60, a reference marker 66 is shown at the top side of the module 60. This reference marker 66 is located in FIGS. 1 and 3 on the right side and in FIG. 2 on the left side. The receiving socket 10 is shown in the same orientation in all the figures.

When the module 60 is withdrawn, the contact element 40 comes into abutment with the first contact area 22 and the second contact area 32 so that an electrical connection is produced between the contact areas 22 and 32. A signal can thus be passed from the input 12 to the output 14.

With the assembly according to the invention, the receiving socket 10 according to the invention and the electronic module 60 according to the invention, different switching conditions, namely in particular a working position, a start-up position and an exchange position, can be easily provided.

The invention claimed is:

1. An assembly, comprising:

an electronic module for insertion into a receiving socket, with an electronic circuit and with a first contact blade and a second contact blade which are each electrically connected to the electronic circuit, wherein at least one of the contact blades has an electrical contact area formed on a front side and an insulating area formed on a rear side; and the receiving socket for receiving and making contact with the electronic module which comprises the electronic circuit which is electrically connected to the first contact blade and the second contact blade, with a first electrical contact area to make contact with the first contact blade of the module, with a second electrical contact area to make contact with the second contact blade of the module, and with a contact element which electrically connects the first contact area to the second contact area in order to forward an electrical signal when the module is removed, wherein the first contact blade of the module can be received between the first electrical contact area and the contact element and wherein the second contact blade of the module can be received between the second electrical contact area and the contact element, wherein the module has a symmetrical structure that can be inserted into the receiving socket in two different orientations, wherein the positions of the contact blades are exchanged, the receiving socket is adapted to receive the module in the two different orientations rotated by 180 degrees relative to each other, wherein in the two different orientations, when the module is inserted, an electrical connection produced by the contact element electrically connecting the first electrical contact area to the second electrical contact area of the receiving socket is interrupted by the insulating area on the rear side of the at least one contact blades.

2. The assembly according to claim 1, wherein the contact blades of the module can be clamped between the contact areas and the contact element.

3. The assembly according to claim 1, wherein at least one of the contact areas or the contact element is pre-tensioned to clamp in the contact blades of the module.

4. The assembly according to claim 1, wherein the contact areas are arranged in a shared plane.

5. The assembly according to claim 1, wherein the module can be linearly inserted.

6. The assembly according to claim 1, wherein the receiving socket comprises a housing with at least one guide rail to receive and linearly guide the module.

7. The assembly according to claim 1, wherein the receiving socket comprises a U-shaped housing with a receiving space to receive the module.

8. The assembly according to claim 1, wherein the contact element is designed as a contact plate.

9. The assembly according to claim 1, wherein the first electrical contact area is electrically connected to a signal input and the second electrical contact area is electrically connected to a signal output.

10. The assembly according to claim 1, wherein the module can be positioned in the receiving socket in two different orientations, wherein the contact blades of the module are each received between the contact areas and the contact element of the receiving socket, in a first orientation of the module an electrical contact exists between the first contact blade of the module and the first contact area of the receiving socket and also between the second contact blade of the module and the second contact area of the receiving socket and in a second orientation of the module the electrical contact between the at least one of the contact blades of the module and the corresponding contact area of the receiving socket is interrupted by the insulating area formed on the rear side of the at least one of the contact blades.

11. The assembly according to claim 1, wherein the assembly is arranged in a switching circuit.

* * * * *